US011664149B2

(12) United States Patent
Park et al.

(10) Patent No.: US 11,664,149 B2
(45) Date of Patent: May 30, 2023

(54) COIL ELECTRONIC COMPONENT

(71) Applicant: SAMSUNG ELECTRO-MECHANICS CO., LTD., Suwon-si (KR)

(72) Inventors: Kwang Il Park, Suwon-si (KR); Jong Min Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 884 days.

(21) Appl. No.: 16/550,716

(22) Filed: Aug. 26, 2019

(65) Prior Publication Data

US 2020/0143975 A1 May 7, 2020

(30) Foreign Application Priority Data

Nov. 7, 2018 (KR) ..... 10-2018-0135730

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/29* (2013.01); *H01F 27/323* (2013.01);
(Continued)

(58) Field of Classification Search
CPC ..... H01F 27/2804
(Continued)

(56) References Cited

U.S. PATENT DOCUMENTS 9,812,257 B2 11/2017 Itoh et al.
2015/0380152 A1* 12/2015 Itoh ..... H01F 41/041 336/200
2018/0033538 A1 2/2018 Yoon et al.

FOREIGN PATENT DOCUMENTS

JP 2014-49598 A 3/2014
JP 2016-009827 A 1/2016
(Continued)

OTHER PUBLICATIONS

Korean Office Action dated Feb. 2, 2023, issued in corresponding Korean Patent Application No. 10-2018-0135730 with English translation.

*Primary Examiner* — Ronald Hinson
(74) *Attorney, Agent, or Firm* — Morgan, Lewis & Bockius LLP

(57) ABSTRACT

A coil electronic component includes a support substrate having a through-hole. First and second coil patterns are disposed on a first surface and a second surface of the support substrate opposing each other, respectively, and each surround the through-hole and are coiled. An encapsulant encapsulates at least portions of the support substrate and the first and second coil patterns, and external electrodes are disposed externally of the encapsulant and are each connected to a respective lead-out pattern connected to a respective one of the first and second coil patterns. A groove penetrates the first surface of the support substrate in a region of the first surface in which the first coil pattern is not disposed, and the second coil pattern is disposed in a region of the second surface of the support substrate that overlaps along a thickness direction with the groove penetrating the first surface.

21 Claims, 6 Drawing Sheets

(51) Int. Cl.
*H01F 27/29* (2006.01)
*H01F 27/32* (2006.01)
*H01F 41/04* (2006.01)

(52) U.S. Cl.
CPC ..... *H01F 27/327* (2013.01); *H01F 41/041* (2013.01); *H01F 2027/2809* (2013.01)

(58) Field of Classification Search
USPC ..... 336/200
See application file for complete search history.

(56) References Cited

FOREIGN PATENT DOCUMENTS

| | | | |
|---|---|---|---|
| KR | 10-2017-0097441 | A | 8/2017 |
| KR | 10-2017-0097445 | A | 8/2017 |
| KR | 10-2018-0012618 | A | 2/2018 |
| KR | 10-2018-0084307 | A | 7/2018 |

* cited by examiner

COIL ELECTRONIC COMPONENT

CROSS-REFERENCE TO RELATED APPLICATION(S)

This application claims benefit of priority to Korean Patent Application No. 10-2018-0135730 filed on Nov. 7, 2018 in the Korean Intellectual Property Office, the disclosure of which is incorporated herein by reference in its entirety.

BACKGROUND

1. Field

The present disclosure relates to a coil electronic component.

2. Description of Related Art

As electronic devices such as digital televisions, mobile phones, laptops, and the like, have been designed to have reduced sizes, demand has increased for coil electronic components configured for use in such electronic devices and having reduced size. To meet such demand, a large number of studies into developing various types of coil-type or thin-film type coil electronic components have been conducted.

One important difficulty in developing a coil electronic component having a reduced size is to provide a coil component having the same properties as before after reducing a size thereof. To this end, a content of a magnetic material filling a core may be increased. However, there may be a limitation in increasing the content of the magnetic material due to strength of an inductor body, changes in frequency property caused by insulating property, and for other reasons.

There have been continuous attempts to further reduce a thickness of a chip including a coil electronic component. In particular, in the respective technical field, efforts have been made to provide devices exhibiting high performance and reliability while having a reduced size. Also, efforts to increase strength of a coil electronic component have been made to prevent separation of a coil from a support member, and the like, when stresses are applied while manufacturing or using the coil electronic component.

SUMMARY

An aspect of the present disclosure is to provide a coil electronic component which may have improved strength to reduce a warpage defect caused when external stresses are applied, and which may accordingly have improved stability and reliability.

According to an aspect of the present disclosure, a coil electronic component includes a support substrate having a through-hole, and first and second coil patterns disposed on a first surface and a second surface of the support substrate opposing each other in a thickness direction, respectively, the first and second coil patterns each surrounding the through-hole and coiled. An encapsulant encapsulates at least portions of the support substrate and the first and second coil patterns, and external electrodes are disposed externally of the encapsulant and are each connected to a respective lead-out pattern connected to a respective one of the first and second coil patterns. A groove penetrates the first surface of the support substrate in a region of the first surface of the support substrate in which the first coil pattern is not disposed, and the second coil pattern is disposed in a region of the second surface of the support substrate that overlaps along the thickness direction with the groove penetrating the first surface.

A second groove penetrates the second surface of the support substrate in a region of the second surface of the support substrate in which the second coil pattern is not disposed, and the first coil pattern may be disposed in a region of the first surface of the support substrate that overlaps along the thickness direction with the second groove penetrating the second surface.

The groove penetrating the first surface and the second groove penetrating the second surface may be laterally offset from each other along a width direction orthogonal to the thickness direction.

The groove penetrating the first surface and the second groove penetrating the second surface may be spaced apart from each other.

An internal wall of the support substrate facing the through-hole may have an inclined surface.

The internal wall may include at least two inclined surfaces, inclined at different angles relative to the first surface, and a size of the through-hole may decrease towards a center region of the support substrate along the thickness direction.

The second coil pattern may have a same shape as the first coil pattern, and may be disposed on the support substrate so as to be shifted relative to the first coil pattern in a side direction orthogonal to the thickness direction.

The second coil pattern may be shifted in first and second directions perpendicular to each other and to the thickness direction.

The first and second coil patterns may have different shapes.

A width of a central hole penetrating through the first coil pattern may be different from a width of a central hole penetrating through the second coil pattern.

A number of turns of the first coil pattern may be different from a number of turns of the second coil pattern.

A width of the first coil pattern may be different from a width of the second coil pattern.

The encapsulant may include magnetic particles, and the through-hole may be filled with the encapsulant.

The groove may be filled with the encapsulant.

In accordance with another aspect of the disclosure, a coil electronic component includes a support substrate having a through-hole extending between first and second opposing surfaces, and a first coil pattern disposed in a spiral pattern surrounding the through-hole on the first surface of the support substrate. A groove penetrates the first surface of the support substrate and has a spiral pattern disposed between adjacent windings of the first coil pattern.

The support substrate may have a thickness, measured orthogonally to the first surface, in a region of the groove that is lower than a thickness in a region of the first coil pattern.

The groove may have a side surface that is inclined so as to be non-orthogonal relative to the first surface of the support substrate, and an internal wall of the support substrate facing the through-hole may be inclined so as to be non-orthogonal relative to the first surface of the support substrate.

The coil electronic component may further include a second groove penetrating the second surface of the support substrate and having a spiral pattern that is spaced apart from the groove penetrating the first surface, and the first and second grooves may be laterally offset from each other along a side direction parallel to the first surface.

The second groove may overlap with the first coil pattern along a thickness direction orthogonal to the first surface of the support substrate.

A second coil pattern may be disposed in a spiral pattern surrounding the through-hole on the second surface of the support substrate, and may have the second groove disposed between adjacent windings thereof, and the second coil pattern may be disposed in a region of the second surface of the support substrate that overlaps along a thickness direction with the groove penetrating the first surface.

The coil electronic component may further include a second coil pattern disposed in a spiral pattern surrounding the through-hole on the second surface of the support substrate. The second coil pattern may be disposed in a region of the second surface of the support substrate that overlaps along a thickness direction with the groove penetrating the first surface, and a width of a central hole penetrating through the first coil pattern may be different from a width of a central hole penetrating through the second coil pattern.

The coil electronic component may further include a second coil pattern disposed in a spiral pattern surrounding the through-hole on the second surface of the support substrate. The second coil pattern may be disposed in a region of the second surface of the support substrate that overlaps along a thickness direction with the groove penetrating the first surface, and a width of a central hole penetrating through the first coil pattern may be the same as a width of a central hole penetrating through the second coil pattern.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
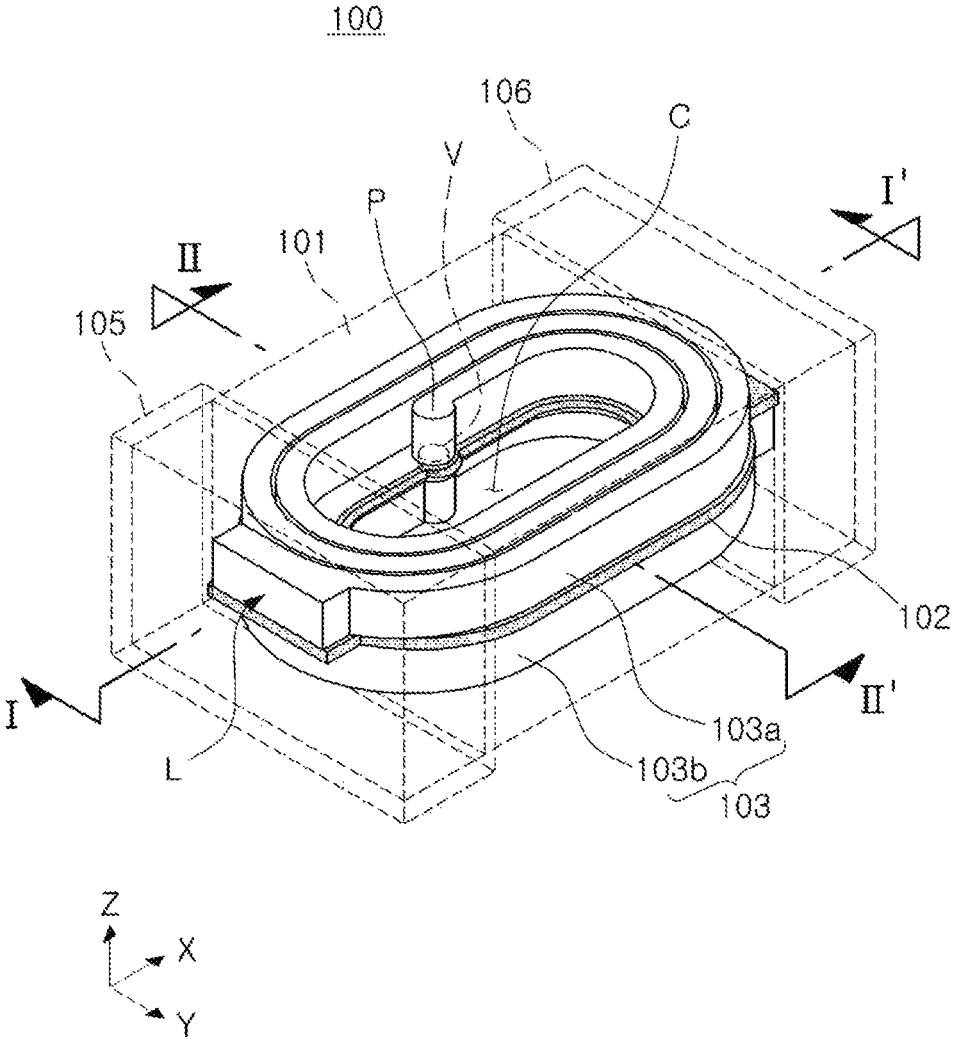
FIG. 1 is a perspective diagram illustrating a coil electronic component according to an example embodiment of the present disclosure.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art. Accordingly, shapes and sizes of the elements in the drawings can be exaggerated for clear description. Also, elements having the same function within the scope of the same concept represented in the drawing of each exemplary embodiment will be described using the same reference numerals.

Figure 2:
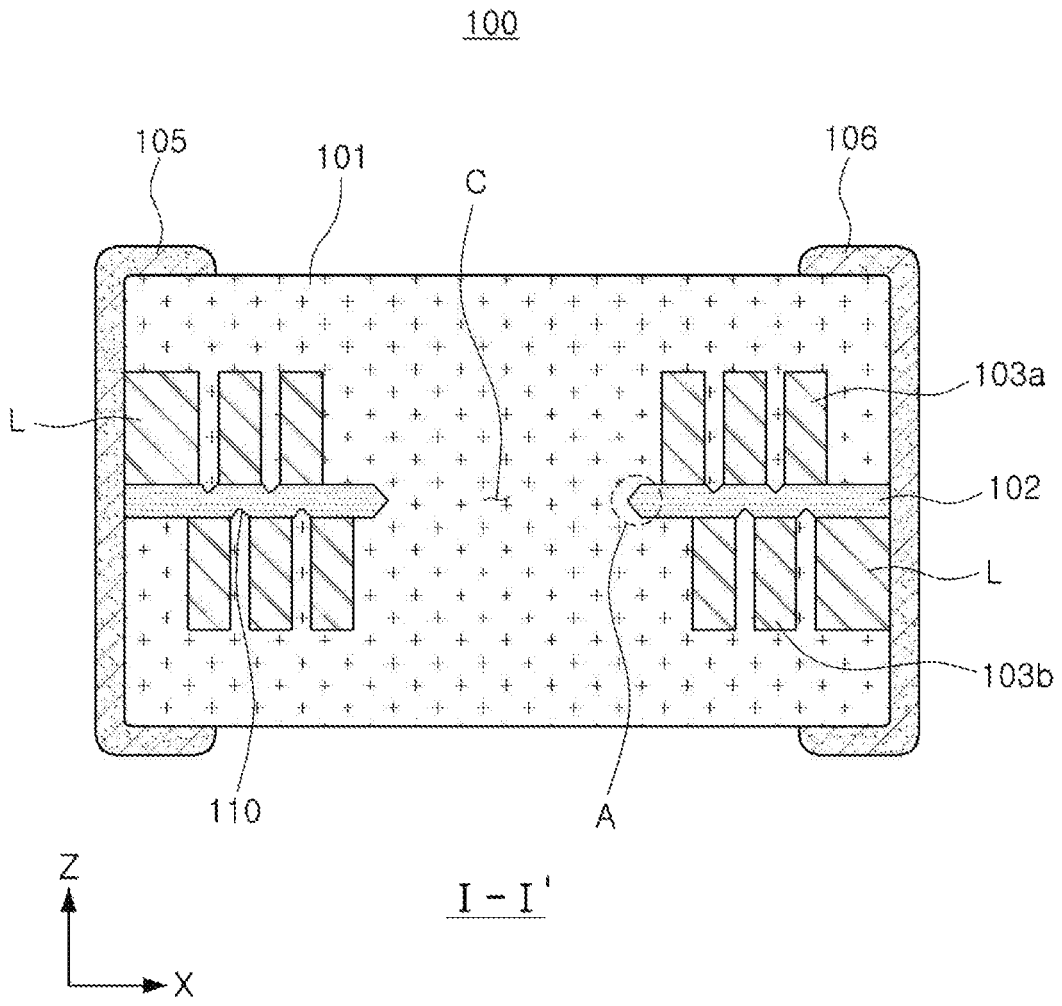
FIGS. 2 and 3 are cross-sectional diagrams taken along lines I-I' and II-II' in FIG. 1, respectively.
Figure 3:
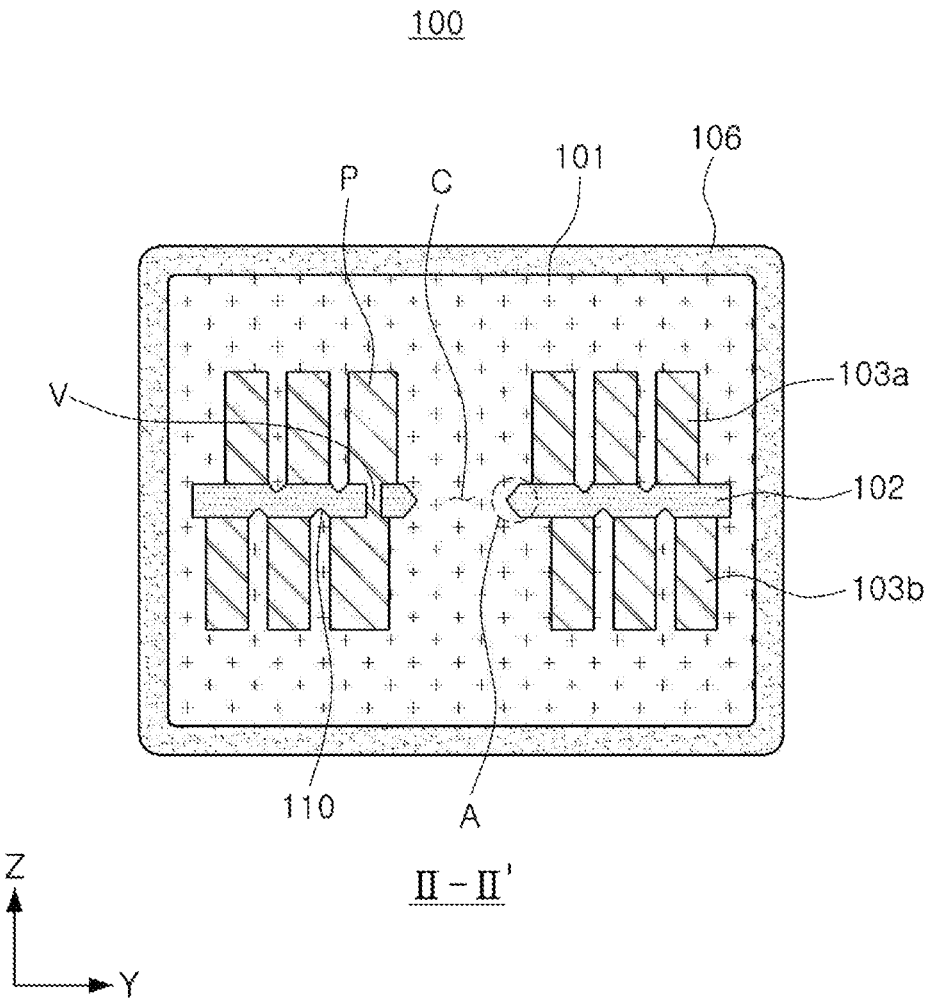
Figure 4:
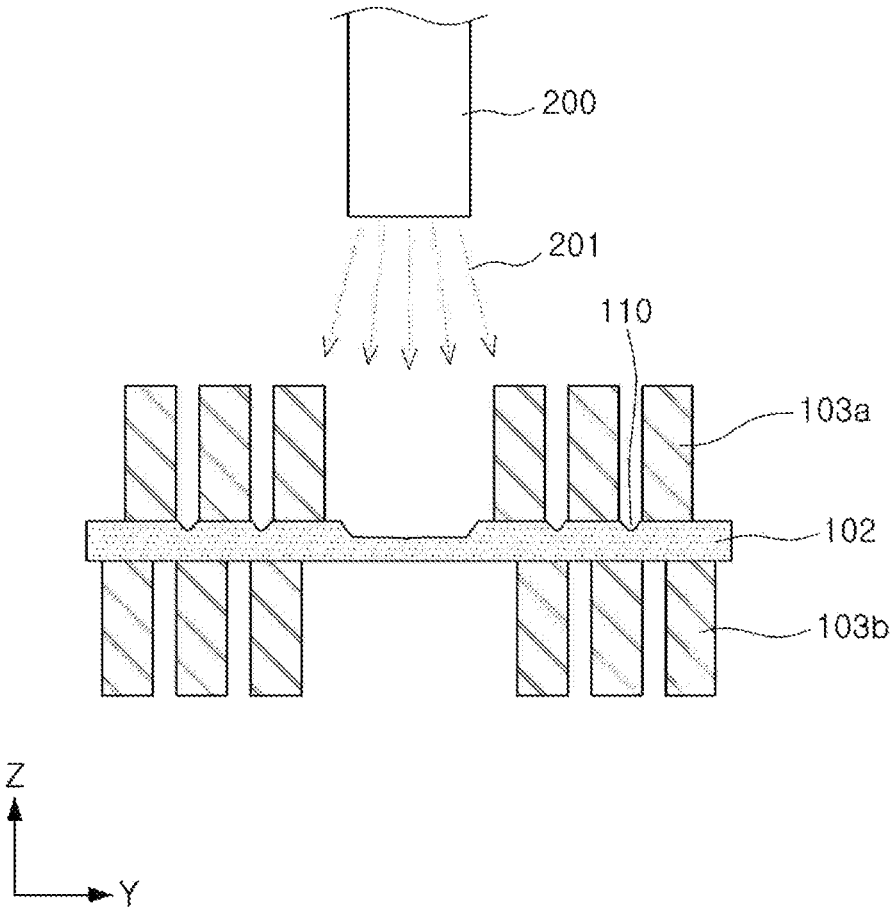
FIG. 4 is a diagram illustrating a laser process of a method of manufacturing a coil electronic component.
Figure 5:
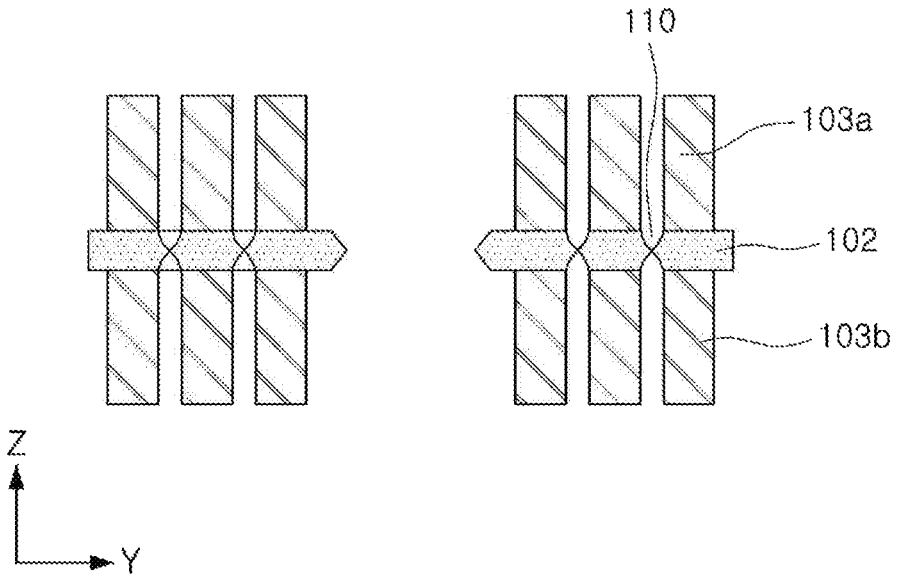
FIG. 5 is a diagram illustrating a state of a coil electronic component after a laser process.

FIG. 1 is a perspective diagram illustrating a coil electronic component according to an example embodiment. FIGS. 2 and 3 are cross-sectional diagrams taken along lines I-I' and II-II' in FIG. 1, respectively. FIG. 4 is a diagram illustrating a laser process of a method of manufacturing a coil electronic component. FIG. 5 is a diagram illustrating a state of a coil electronic component after a laser process.

Referring to FIGS. 1 to 3, a coil electronic component 100 in the example embodiments may include an encapsulant 101, a support substrate 102, a coil pattern 103, and external electrodes 105 and 106, and groove(s) 110 may be formed in a surface of the support substrate 102.

The encapsulant 101 may encapsulate at least portions of the support substrate 102 and the coil pattern 103, and may form an exterior of the coil electronic component 100. In this case, the encapsulant 101 may be configured to externally expose partial regions of lead-out patterns L. The encapsulant 101 may include magnetic particles or grains, and an insulating resin may be interposed between the magnetic particles or grains. Surfaces of the magnetic particles or grains may be coated with an insulating film.

As the magnetic particles or grains included in the encapsulant 101, ferrite, a metal, and the like, may be used. When the magnetic particles or grains are implemented by a metal, the magnetic particles or grains may be an Fe-based alloy, and the like. For example, the magnetic particles or grains may be a nanocrystalline alloy having a composition of Fe—Si—B—Cr, an Fe—Ni based alloy, and the like. When the magnetic particles or grains are implemented by an Fe-based alloy, magnetic properties such as permeability may improve, but the magnetic particles or grains may be vulnerable to electrostatic discharge (ESD). Accordingly, an additional insulation structure may be interposed between the coil pattern 103 and the magnetic particles or grains.

The support substrate 102 may support the coil pattern 103, and may be implemented as a polypropylene glycol (PPG) substrate, a ferrite substrate or a metal-based soft magnetic substrate, and the like. As illustrated in the diagram, a through-hole C may be formed in a central portion of the support substrate 102, penetrating through the support substrate 102, and the through-hole C may be filled with the encapsulant 101, thereby forming a magnetic core portion. The groove(s) 110 formed in a surface of the support substrate 102 may be filled with the encapsulant 101 such that cohesion force between the support substrate 102 and the encapsulant 101 may improve.

As illustrated in the diagram, an internal wall A of the support substrate 102 forming (or facing) the through-hole C may have an inclined surface or inclined surfaces (e.g., a surface or surfaces that are non-orthogonal and non-parallel to the surface(s) on which the coil pattern(s) are disposed). In this case, the internal wall A of the support substrate 102 may include at least two inclined surfaces, inclined at different angles (in the example embodiment, two inclined surfaces are formed), and a size (e.g., an open area) of the through-hole C may decrease towards an inner region of the support substrate 102 (e.g., towards a middle of the support substrate 102) in a thickness direction (Z direction in the diagram). Such a shape of the support substrate 102 may be formed in the process of forming the through-hole C using a laser process, and the configuration will be described in greater detail later.

The coil pattern 103 may include multiple windings so as to be coiled while surrounding the through-hole C of the support substrate 102, and may include first and second coil patterns 103*a* and 103*b*. The first and second coil patterns 103*a* and 103*b* may be disposed on a first surface (an upper surface in FIG. 2) and a second surface (a lower surface FIG. 2) of the support substrate 102 opposing each other, respectively. In this case, each of the first and second coil patterns 103*a* and 103*b* may include a pad region P, and may be connected to each other through a via V penetrating the support substrate 102. The coil pattern 103 may be formed through a plating process used in the respective technical field, such as a pattern plating process, an anisotropic plating process, an isotropic plating process, or the like, and may be configured to have a multilayer structure using a plurality of processes among the above-mentioned processes.

The external electrodes 105 and 106 may be disposed externally of the encapsulant 101 and may be connected to the lead-out pattern(s) L (e.g., connected to respective lead-out pattern(s)). The external electrodes 105 and 106 may be formed using a paste including a metal having high electrical conductivity, and the paste may be a conductive paste including one of nickel (Ni), copper (Cu), tin (Sn) or silver (Ag), or alloys thereof, for example. Each of the external electrodes 105 and 106 may further include a plating layer formed thereon. In this case, the plating layer may include one or more elements selected from a group consisting of nickel (Ni), copper (Cu), and tin (Sn). For example, a nickel (Ni) plating layer and a tin (Sn) plating layer may be sequentially formed in order.

The lead-out pattern(s) L may be disposed in an outermost region (e.g., outermost winding(s)) of the coil pattern 103, may provide connection path (s) with the external electrodes 105 and 106, and may be configured to be integrated with the coil pattern 103. In this case, as illustrated in the diagram, the lead-out pattern(s) L may be configured to have a width greater than a width of windings of the coil pattern 103 so as to be connected to the external electrodes 105 and 106. The width may be a width taken in the X direction in FIG. 1.

In the example embodiment, the groove(s) 110, corresponding to areas of the support substrate 102 from which a surface is partially removed, may be formed in a region of the first surface of the support substrate 102 in which the first coil pattern 103*a* is not disposed, and the second coil pattern 103*b* may be offset from the first coil pattern 103*a* so as to be disposed in a region of the second surface of the support substrate 102 opposing the groove 110 of the first surface. The groove (s) 110 may also be formed in a region of the second surface of the support substrate 102 in which the second coil pattern 103*b* is not disposed, and the first coil pattern 103*a* may be disposed in a region of the first surface of the support substrate 102 opposing the groove 110 of the second surface. The diagram illustrates an example in which the groove (s) 110 are formed on each of both surfaces of the support substrate 102, but an example embodiment thereof is not limited thereto. The groove 110 may only be formed in one surface of the support substrate 102.

As the groove 110 is formed in the support substrate 102 as described above, the groove 110 of the first surface and the groove 110 of the second surface may not overlap each other in a thickness direction of the support substrate 102. The configuration in which the grooves 110 of the first surface and the second surface do not overlap in the thickness direction of the support substrate 102 may be implemented by adjusting positions in which the first and second coil patterns 103*a* and 103*b* are disposed. For example, when the first and second coil patterns 103*a* and 103*b* have the same shape, the second coil pattern 103*b* may be shifted in a side direction (X and/or Y directions in FIG. 1) of the support substrate 102 with respect to the first coil pattern 103*a* and may be disposed on the support substrate 102. In the example embodiment, the second coil pattern 103*b* is configured to be shifted in a first direction (X direction) and a second direction (Y direction) perpendicular to each other among side directions of the support substrate 102. However, an example embodiment thereof is not limited thereto. The second coil pattern 103*b* may also be shifted in only one of the side directions of the support substrate 102, in only one of the first direction (X direction) and the second direction (Y direction), for example.

As the first and second coil patterns 103*a* and 103*b* are configured as above, the support substrate 102 may be effectively protected during forming of the through-hole C in the support substrate 102. Referring to FIG. 4, when the through-hole is formed in the support substrate 102 using a laser processing device 200, a laser beam 201 may be irradiated to a central portion of the support substrate 102 and may also be spread and irradiated to region(s) in which the coil pattern 103 is not disposed. Accordingly, the groove 110 may also be formed in a region between windings of the coil patterns 103 in which the coil pattern 103 is not formed, as well as in the central portion of the support substrate 102. The smaller the size of the coil electronic component 100, the more the number and size of the groove(s) 110 may increase. FIG. 4 illustrates an example in which the laser beam 201 is irradiated from an upper portion of the support substrate 102, but the laser beam 201 may also be irradiated from a lower portion. In this case, the groove 110 may also be formed on a second surface (a lower surface) of the support substrate 102. When the laser beam 201 is irradiated from the upper portion and the lower portion of the support substrate 102, two inclined surfaces, inclined at different angles, may be formed on the internal wall A of the support substrate 102 as illustrated in FIGS. 1 to 3.

In the example illustrated in FIG. 5, a comparative example, the first and second coil patterns 103*a* and 103*b* are disposed in the same position on the first surface and the second surface (e.g., in alignment or direct overlap with each other in the thickness direction), and the groove(s) 110 may thus also be formed in the same position on the first surface and the second surface when a laser process is performed in the upper portion and the lower portion. Accordingly, the grooves 110 on the first surface and the second surface may be connected to each other, and may expand in a form of a plurality of through-holes. When the number and a depth of the groove(s) 110 formed in a surface of the support substrate 102 increases, the groove may degrade strength against warpage of the support substrate 102. Thus, in the example illustrated in FIG. 5, the support substrate 102 may be deformed and bent by even a small stress, which may cause defects such as a short of the coil pattern 103, and the like.

In the example embodiment, the groove 110 formed in the first surface of the support substrate 102 may be effectively blocked by the second coil pattern 103*b* facing the groove 110, and similarly, the groove 110 formed in the second surface of the support substrate 102 may be effectively blocked by the first coil pattern 103*a* facing the groove 110. When the grooves 110 formed in the first surface and the second surface of the support substrate 102 are separated from each other as described above, strength of the support substrate 102 may improve such that structural stability and reliability of the coil electronic component 100 may improve.

Figure 6:
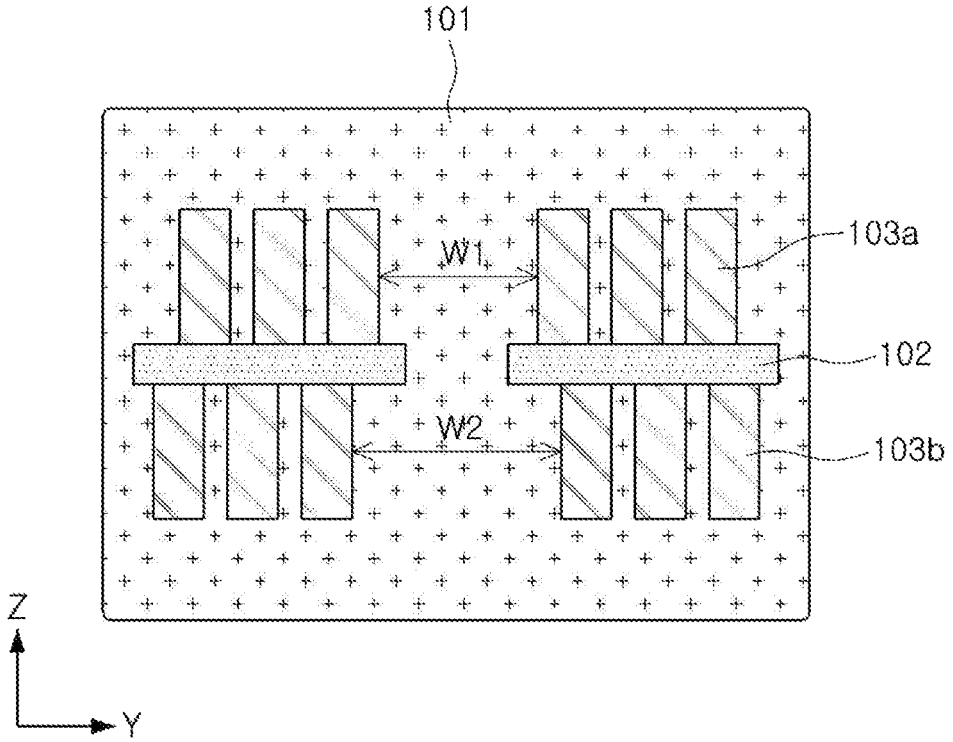
FIGS. 6 to 8 are diagrams illustrating coil electronic components according to modified example embodiments.
Figure 7:
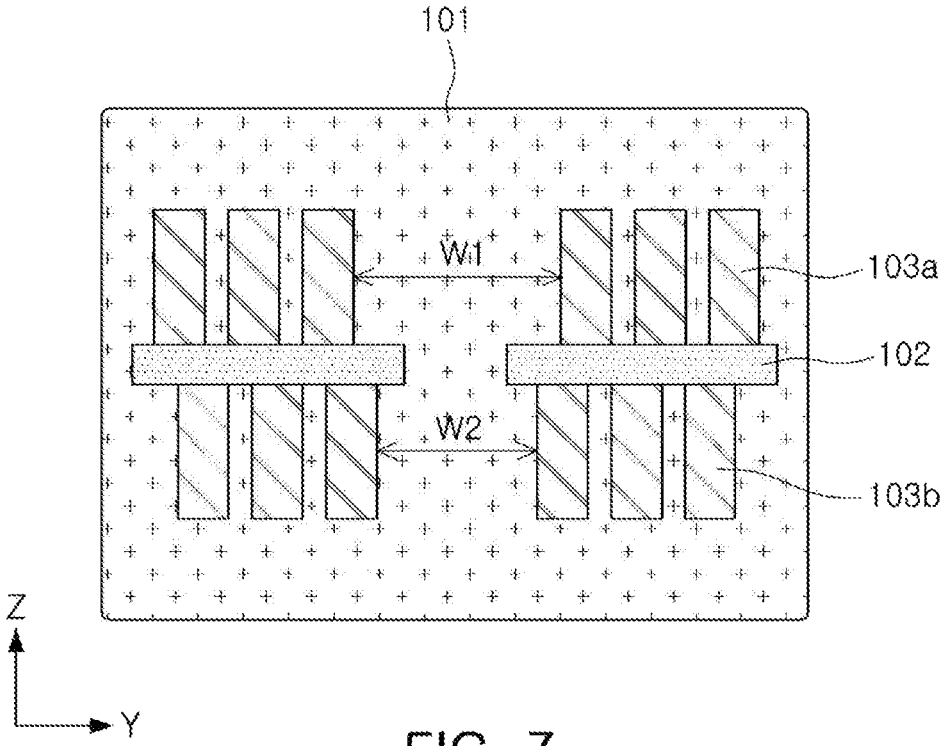
Figure 8:
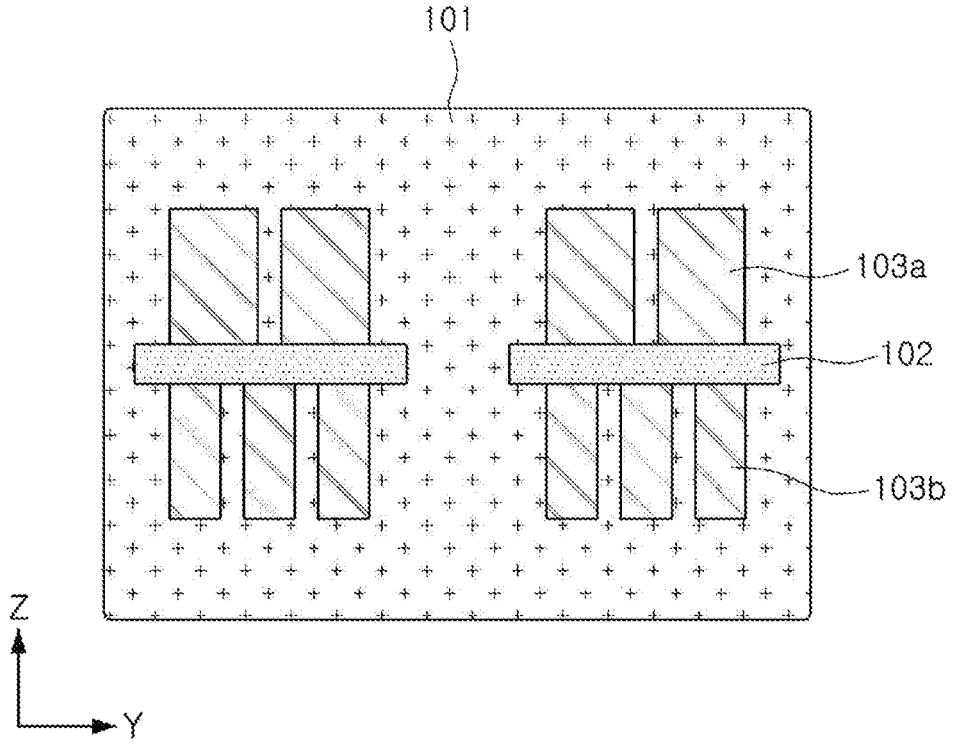

FIGS. 6 to 8 are diagrams illustrating a coil electronic component according to modified example embodiments. In the description below, external electrodes and grooves are not illustrated for ease of description. However, these coil electronic components may generally include external electrodes and grooves such as those shown in FIGS. 1 to 3. In the coil electronic component illustrated in the modified example in FIG. 6, first and second coil patterns 103*a* and 103*b* may have different shapes. For example, widths of cores formed by the first and second coil patterns 103*a* and 103*b* may be different from each other. For instance, a width W1 of a core formed by the first coil pattern 103*a* may be smaller than a width W2 of a core formed by the second coil pattern 103*b*. Differently from the above-described example embodiment, the width W1 of a core formed by the first coil pattern 103*a* may be configured to be greater than the width W2 of a core formed by the second coil pattern 103*b* as in the example embodiment illustrated in FIG. 7. In the modified examples in FIGS. 6 and 7, grooves in the first surface and the second surface of the support substrate 102 may not overlap each other in a region in which the coil pattern is formed in the thickness direction of the support substrate 102, and accordingly, the support substrate 102 may be effectively protected from a laser process. As illustrated in the example illustrated in FIG. 7, when the width W1 of the core of the first coil pattern 103*a* in an upper portion of the support substrate 102 is configured to be greater than the width W2 of the lower portion, rated current properties may improve.

In the modified example in FIG. 8, the first and second coil patterns 103*a* and 103*b* may have different shapes. A number of turns of the first coil pattern 103*a* may be different from a number of turns of the second coil pattern 103*b*, and the number of turns of the second coil pattern 103*b* may be greater than the number of turns of the first coil pattern 103*a*. Alternatively, the number of turns of the first coil pattern 103*a* may be configured to be greater than the number of turns of the second coil pattern 103*b*. Additionally or alternatively, a width of the first coil pattern 103*a* (a width of conductor windings of the first coil pattern 103*a*) may be different from a width of the second coil pattern 103*b* (a width of conductor windings of the second coil pattern 103*b*), and a width of the first coil pattern 103*a* is greater than a width of the second coil pattern 103*b* in the example embodiment illustrated in FIG. 8. Alternatively, a width of the second coil pattern 103*b* may be greater than a width of the first coil pattern 103*a*. In the example embodiment illustrated in FIG. 8, grooves in the first surface and the second surface of the support substrate 102 may not overlap in a region in which the coil pattern is formed in a thickness direction of the support substrate 102, and accordingly, the support substrate 102 may be effectively protected from a laser process. In the example embodiment illustrated in FIG. 8, a size of a cross-sectional surface of the first coil pattern 103*a* may increase such that direct current resistance properties (Rdc) may improve.

According to the aforementioned example embodiments, as the coil electronic component has high strength, a warpage defect, and the like, may be reduced when external stresses are applied, thereby improving stability and reliability.

While the exemplary embodiments have been shown and described above, it will be apparent to those skilled in the art that modifications and variations could be made without departing from the scope of the present invention as defined by the appended claims.

What is claimed is:

1. A coil electronic component, comprising:

a support substrate having a through-hole;

first and second coil patterns disposed on a first surface and a second surface of the support substrate opposing each other in a thickness direction, respectively, the first and second coil patterns each surrounding the through-hole and coiled;

an encapsulant encapsulating at least portions of the support substrate and the first and second coil patterns; and external electrodes disposed externally of the encapsulant and each connected to a respective lead-out pattern connected to a respective one of the first and second coil patterns, wherein a groove penetrates the first surface of the support substrate in a region of the first surface of the support substrate in which the first coil pattern is not disposed, and wherein the second coil pattern is disposed in a region of the second surface of the support substrate that overlaps along the thickness direction with the groove penetrating the first surface.

2. The coil electronic component of claim 1, wherein a second groove penetrates the second surface of the support substrate in a region of the second surface of the support substrate in which the second coil pattern is not disposed, and wherein the first coil pattern is disposed in a region of the first surface of the support substrate that overlaps along the thickness direction with the second groove penetrating the second surface.

3. The coil electronic component of claim 2, wherein the groove penetrating the first surface and the second groove penetrating the second surface are laterally offset from each other along a width direction orthogonal to the thickness direction.

4. The coil electronic component of claim 2, wherein the groove penetrating the first surface and the second groove penetrating the second surface are spaced apart from each other.

5. The coil electronic component of claim 1, wherein an internal wall of the support substrate facing the through-hole has an inclined surface.

6. The coil electronic component of claim 5, wherein the internal wall includes at least two inclined surfaces, inclined at different angles relative to the first surface, and a size of the through-hole decreases towards a center region of the support substrate along the thickness direction.

7. The coil electronic component of claim 1, wherein the second coil pattern has a same shape as the first coil pattern, and is disposed on the support substrate so as to be shifted relative to the first coil pattern in a side direction orthogonal to the thickness direction.

8. The coil electronic component of claim 7, wherein the second coil pattern is shifted in first and second directions perpendicular to each other and to the thickness direction.

9. The coil electronic component of claim 1, wherein the first and second coil patterns have different shapes.

10. The coil electronic component of claim 9, wherein a width of a central hole penetrating through the first coil pattern is different from a width of a central hole penetrating through the second coil pattern.

11. The coil electronic component of claim 9, wherein a number of turns of the first coil pattern is different from a number of turns of the second coil pattern.

12. The coil electronic component of claim 9, wherein a width of the first coil pattern is different from a width of the second coil pattern.

13. The coil electronic component of claim 1, wherein the encapsulant includes magnetic particles, and the through-hole is filled with the encapsulant.

14. The coil electronic component of claim 13, wherein the groove is filled with the encapsulant.

15. A coil electronic component comprising:

a support substrate having a through-hole extending between first and second opposing surfaces;

a first coil pattern disposed in a spiral pattern surrounding the through-hole on the first surface of the support substrate; and a groove penetrating the first surface of the support substrate and having a spiral pattern disposed between adjacent windings of the first coil pattern, wherein the groove has a side surface that is inclined so as to be non-orthogonal relative to the first surface of the support substrate, and an internal wall of the support substrate facing the through-hole is inclined so as to be non-orthogonal relative to the first surface of the support substrate.

16. The coil electronic component of claim 15, wherein the support substrate has a thickness, measured orthogonally to the first surface, in a region of the groove that is lower than a thickness in a region of the first coil pattern.

17. The coil electronic component of claim 15, further comprising:

a second groove penetrating the second surface of the support substrate and having a spiral pattern that is spaced apart from the groove penetrating the first surface, wherein the first and second grooves are laterally offset from each other along a side direction parallel to the first surface.

18. The coil electronic component of claim 17, wherein the second groove overlaps with the first coil pattern along a thickness direction orthogonal to the first surface of the support substrate.

19. The coil electronic component of claim 17, further comprising a second coil pattern disposed in a spiral pattern surrounding the through-hole on the second surface of the support substrate, and having the second groove disposed between adjacent windings thereof, wherein the second coil pattern is disposed in a region of the second surface of the support substrate that overlaps along a thickness direction with the groove penetrating the first surface.

20. The coil electronic component of claim 15, further comprising a second coil pattern disposed in a spiral pattern surrounding the through-hole on the second surface of the support substrate, wherein the second coil pattern is disposed in a region of the second surface of the support substrate that overlaps along a thickness direction with the groove penetrating the first surface, and wherein a width of a central hole penetrating through the first coil pattern is different from a width of a central hole penetrating through the second coil pattern.

21. The coil electronic component of claim 15, further comprising a second coil pattern disposed in a spiral pattern surrounding the through-hole on the second surface of the support substrate, wherein the second coil pattern is disposed in a region of the second surface of the support substrate that overlaps along a thickness direction with the groove penetrating the first surface, and wherein a width of a central hole penetrating through the first coil pattern is the same as a width of a central hole penetrating through the second coil pattern.

* * * * *